United States Patent [19]

Van Buskirk et al.

[11] 4,440,306

[45] Apr. 3, 1984

[54] TAMPER-EVIDENT CLOSURE

[75] Inventors: E. James Van Buskirk, Norwich; James Ennis, Preston, both of Conn.

[73] Assignee: Silver Industries, Norwich, Conn.

[21] Appl. No.: 457,370

[22] Filed: Jan. 12, 1983

[51] Int. Cl.[3] ..... B65D 55/02

[52] U.S. Cl. ..... 215/230

[58] Field of Search ..... 215/365, 230, 203, 219

[56] References Cited

U.S. PATENT DOCUMENTS 2,939,597 6/1960 Greene ..... 215/230

*Primary Examiner*—Donald F. Norton

*Attorney, Agent, or Firm*—Murray & Whisenhunt

[57] ABSTRACT

A tamper evident closure including a threaded cap for a threaded container neck and an enclosing cap mounted on the threaded cap. The threaded cap is provided with indicia which is permanently visible through a transparent portion or aperture in the enclosing cap after the closure is removed from the container.

12 Claims, 5 Drawing Figures

TAMPER-EVIDENT CLOSURE

The present invention relates to a tamper-evident closure for containers, and more particularly to such tamper-evident closure for containers with a threaded neck for receiving the closure. More specifically, the invention relates to such a tamper-evident closure that permanently displays tampering indicia when the closure is first removed from the container.

BACKGROUND OF THE INVENTION

Due to increases in vandalic tampering with the contents of packages, particularly containers for medicaments, foods and the like, the art has sought convenient and inexpensive ways of protecting such containers from such vandalic tampering.

To avoid such vandalic tampering, the art has proposed the use of container closures which are essentially mechanically sealed, but this approach in the art has been generally unsuccessful, since once the mechanical seal is broken, reclosing the container for subsequent intermittent use by the consumer is difficult, and in some cases, impossible.

Another approach in the art is that of providing a closure which is difficult to open, and not convenient for surreptitious opening while the container remains on the retail store shelf. However, these difficult to open closures are most inconvenient to the user and do not ensure that tampering has not occurred.

The third, and more generally accepted approach in the art is that of providing a closure which, while it will not prevent tampering, will show most clearly and obviously when tampering has occured. These types of closures are referred to as tamper-evident closures and it is to this type of closure that the present invention is directed.

Tamper-evident closures, generally, are of the type where the closure has incorporated therewith some element which must either be very noticeably disturbed or broken when the closure is removed from the container. That element is generally referred to a "seal", not in that the closure is literally sealed in the sense of containment, but in the sense of a legal seal, where the disturbance or destruction thereof indicates tampering. Copending and commonly assigned U.S. Patent Application Ser. No. 424,431, filed on Sept. 27, 1982 is an example of a "sealed" closure.

Sealed closures have one very distinct disadvantage and problem. The seal which is either disturbed or broken in removing the closure, must be such an obvious seal that the ordinary consumer can easily detect that something is amiss. For example, if the seal is nothing more than a heat-shrunk film about the closure, the removal thereof in tampering with the container may not result in an obvious disturbance of the container closure. Since consumers are accustomed to many packages not being so sealed, the absence of the seal may not be detected by many consumers.

As another example of a sealed container, metal or plastic film may be glued across the finish of the container, but those films can be removed by the vandal, and again it may not be obvious to the ordinary consumer that the film seal has been removed. Other examples of the difficulties faced by the art in providing sealed containers may be given, but basically the overall problem is that of providing a closure where the absence of the seal will be most obvious to the ordinary consumer. This problem has not been adequately solved for many containers, since ordinary consumers do not now know which containers ordinarily have a seal and which do not, and the absence of the seal may not be conspicuous to the oridinary consumer.

It would therefore be a substantial advantage in the art to provide a tamper-evident closure wherein evidence of the first removal of the closure from the container is permanently displayed on the closure and warns the consumer that that closure has been previously removed from the container. Such a closure would provide even the least discerning consumer with the information that that closure had been previously removed, whether or not the consumer would ordinarily expect that container to be sealed.

OBJECTS OF THE INVENTION

It is therefore an object of the invention to provide a tamper-evident closure which may be used on a variety of containers including containers which do not ordinarily contain a seal and which may be used alone or in combination with the seal. It is a further object of the invention to provide such closure which, when the closure is first removed from the container, provides evidence of that first removal and that evidence will be permanently displayed on the closure. It is a further object of the invention to provide such closure which is easy and inexpensive to manufacture, may be used with conventional automatic filling machines, and is not difficult to remove from and replace on the container, so as to avoid the problems of prior art closure which purposefully included a difficult to remove feature. Other objects will be apparent from the following description of the invention and the claims.

BRIEF DESCRIPTION OF THE INVENTION

The invention is based on four primary discoveries and several subsidiary discoveries. First, it was discovered that in order to avoid the problems of the prior art in connection with tamper-evident closures, as discussed above, the evidence of tampering must be such that that evidence is readily apparent even to the less discerning consumer and even when the closure is on a container which is not ordinarily a sealed container. It is only with this kind of tamper-evidence that it can be assured that even the less discerning consumer will immediately recognize that tampering of a container has occurred. Thus, the evidence of tampering, once tampering occurrs, must be permanently displayed on the closure and that display of the evidence of tampering must be such that it cannot be removed by the vandal.

As the second primary discovery, it was found that in order to provide such permanent evidence of tampering, that evidence must be permanently displayed with the first removal of the closure from the container.

As the third basic discovery, it was found that both of these indispensible features may be achieved by a closure wherein the cap of the container is enclosed in an enclosing means which is rotatable, to a limited degree, in the counter-clockwise direction, such that when the closure is removed from the threaded neck of the container (removal by unthreading in a counter-clockwise direction as is the normal case) the enclosing means rotates relative to the cap and uncovers tampering evidence displayed on the cap.

As the fourth primary discovery, it was found that once this evidence of tampering, displayed on the cap, is uncovered by rotation of the enclosing means when first removing the closure, that enclosing means must then be permanently locked in that display position such that no further rotation on the enclosing means, relative to the cap, will allow that evidence of tampering to not be displayed.

As a subsidiary feature, it was found that in order for such closures to be used in conventional automatic filling machines, the enclosing means must have a clockwise anti-rotation means so that after filling the container, the closure can be threaded to the closed position on the container, without affecting the tamper-evident feature of the closure.

As a further subsidiary discovery, to achieve all of the foregoing features, the closure must have a prepositioning means, which is not easily disturbed, which prepositions the enclosing means, relative to the cap, so that evidence of tampering is not displayed, but when the closure is first rotated to remove the closure from the container, the rotation of the enclosing means displayed that evidence.

With these features rotation of the enclosing means about the cap in the counter-clockwise direction to first open the container will result in the warning indicia, displayed on the cap, being permanently visible through appropriate display areas in the enclosing means.

Thus, briefly stated, the present invention provides a tamper-evident closure for a container having a threaded neck. The closure comprises a cap having a side portion and a top portion and cap threads associated with the side portion for engaging the neck threads such that the cap may be threaded onto the neck in a clockwise direction to close the container and threaded from the neck in a counter-clockwise direction to open the container. An enclosing means is provided for enclosing the side portion and top portion of the cap and the enclosing means is rotatable about the cap only in a counter-clockwise direction (the opening direction). A visible warning indicia is disposed on at least one of the side portion and the top portion of the cap, and transparent means are provided in association with the enclosing means wherein the warning indicia on the cap is visible through those transparent means when the indicia and transparent means are in alignment with each other. A prepositioning means is disposed on the enclosing means and the cap for releasably initially prepositioning the enclosing means on the cap in a preposition where the warning indicia is not aligned nor visible through the transparent means (the position where the closure has not first been removed from the container). Clockwise antirotation means are disposed on the enclosing means and the cap for preventing clockwise rotation of the enclosing means about the cap, so that the closing means and cap may be clockwise rotated to thread the cap onto the neck of the container and close the filled container without disturbing the pre-positioning, as described above, of the enclosing means on the cap. Counter-clockwise rotation limit and locking means are provided for limiting the counter-clockwise rotation of the enclosing means about the cap to a predetermined position where the warning indicia (displayed on the cap) and the transparent means are aligned with each other, and for permanently locking the enclosing means and the cap together in that predetermined position.

Thus, rotation of the enclosing means about the cap in the counter-clockwise direction (the opening direction) to first open the container results in the warning indicia being permanently visible through the transparent means of the enclosing means.

DETAILED DESCRIPTION OF THE INVENTION

Figure 1:
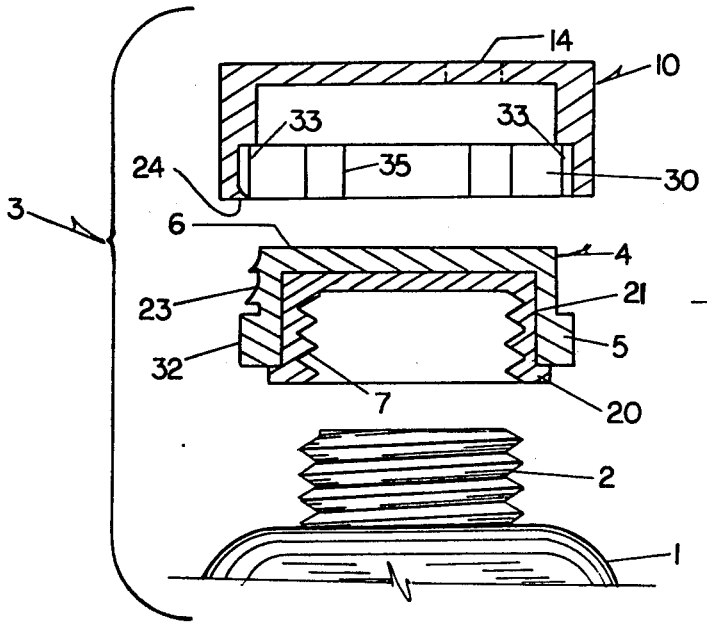
FIG. 1 is a cross-sectioned exploded view of the present closure shown in juxtaposition to a conventional threaded neck container; that cross-section is taken along lines X—X of FIG. 2.
Figure 2:
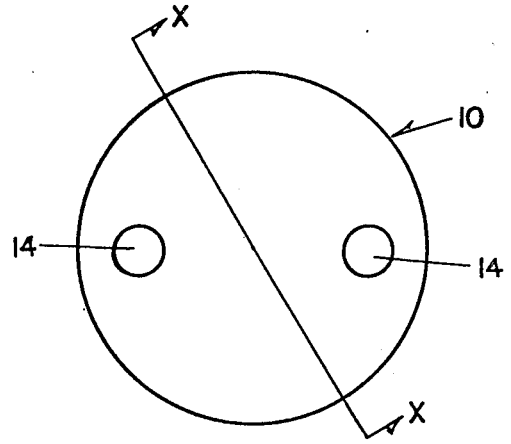
FIG. 2 is a top view of the closure of the present invention.

As can be seen from FIG. 1, which is an exploded cross-sectional view of FIG. 2 along lines X—X, the present tamper-evident closure is suitable for a container 1 having a threaded neck 2. The closure, generally 3, is comprised of a cap, generally 4, having a side portion 5 and a top portion 6. The cap 4 has cap threads 7 associated with side portion 5 for engaging neck threads 2 of container 1 such that the cap may be threaded onto the neck in a clockwise direction to close the container and threaded from the neck in a counter-clockwise direction to open the container, in the normal manner of opening and closing a threaded neck container with a threaded cap.

As shown in the drawings, the threads are screw threads, but it will be appreciated that the threads may be any other type of threads, e.g. bayonet threads, or the like. In addition, while the above shows the cap threads and neck threads in a conventional clockwise to close and counter-clockwise to open arrangement, the vice-versa thereof could be used, and the present specification and claims should be so construed.

The closure 3 also has an enclosing means, generally 10, for enclosing the side portion 5 and the top portion 6 of cap 4. Enclosing means 10 fits over cap 4 in a manner such that enclosing means 10 is rotatable about the cap in a counter-clockwise direction (vice-versa could be true if the threads are vice-versa as described). The details of this rotation will be explained more fully hereinafter.

Figure 4:
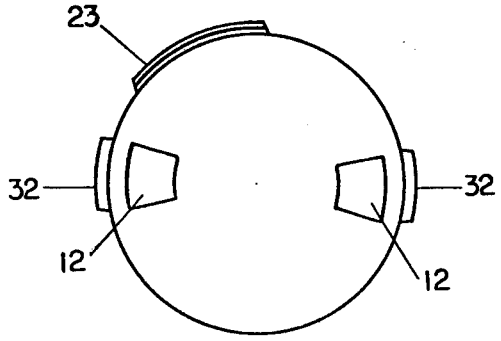
FIG. 4 is a top view of the cap portion of the present closure.

Visible warning indicia is disposed on cap 4. That warning indicia will be disposed at least on one of the side portion 5 or top portion 6 of cap 4, although it could be displayed on any part of cap 4. Usually, however, the warning indicia will be displayed on top portion 6, as shown in FIG. 4, as warning indicia 12. FIG. 4 shows that warning indicia as simply a mark, which may be a colored mark, although, the warning indicia may take a variety of forms. For example, the warning indicia may be symbols, colors or words. For example, a symbol such as a stop sign, or the like may be used, and colors such as the red color or black color may be used, or even words may be used. In this latter regard, for example, the warning indicia may say, "Container previously opened" or, "Warning, container tampered with", or other warning words of choice, as desired.

Transparent means 14 (also see FIG. 2) are associated with enclosing means 10, wherein the warning indicia 12 on cap 4 is visible through the transparent means when the indicia and the transparent means are in alignment with each other. The means and conditions under which this alignment results will be explained more fully hereinafter. In order to make the warning indicia stand out when it is in alignment with the transparent means, the enclosing means 10 is constructed of a material, colored or otherwise treated, such that the warning indicia 12 is not visible or only faintly visible, through enclosing means 10. This means that the warning indicia is only plainly visible when it is in alignment with transparent means 14.

Transparent means 14 may be a transparent portion of enclosing means 10, e.g. a clear portion or a lens portion or the like, or transparent means 14 may simply be an aperture, as shown in FIG. 2, in the enclosing means 10. Usually, there will be more than one warning indicia on the cap and a corresponding number of trasparent means on the enclosing means, e.g. two of each, as shown in FIGS. 2 and 4, although any number, as desired, may be chosen.

As can be appreciated, the object of this arrangement is to provide a closure whereby rotation of the enclosing means about the cap in the counter-clockwise direction to first open the container will result in the warning indicia being permanently visible through the transparent means. To achieve this display of the warning indicia, in a permanent manner, certain requirements must be met in connection with the arrangement of the enclosing means and the cap, and the details of that arrangement are now considered.

In this latter regard, a pre-positioning means is disposed on the enclosing means and the cap for releasably initially pre-positioning the enclosing means on the cap at a predetermined position where the warning indicia is not aligned with nor visible through the transparent means. This preposition of the enclosing means on the cap is the position of the enclosing means relative to the cap when the container has been filled and is ready for purchase and when the closure has experienced no tampering. The prepositioning means will also, normally, have a detent associated therewith such that the enclosing means is not easily rotated from the pre-position. This avoids inadvertent movement of the enclosing means, relative to the cap, where the warning indicia would be displayed.

A clock-wise anti-rotation means is disposed on the closing means and the cap for preventing clockwise rotation of the enclosing means about the cap. The purpose of this clock-wise anti-rotation means is so that the enclosing means and cap may be clockwise rotated to thread the cap onto the neck of the container and close a filled container without disturbing the pre-positioning of the enclosing means on the cap. As can be easily appreciated, modern filling machines are set up to thread a closure onto a filled container, and with the present invention, and the clockwise anti-rotation means, the same modern filling machines may be used.

Of course, as noted above, instead of a clockwise anti-rotation means, the vice-versa may be used when the threads of the cap and neck are also reversed, and the specification and claims should be so construed.

A counter-clockwise rotation limit and locking means is disposed on the enclosing means and the cap for limiting the counter-clockwise rotation of the enclosing means about the cap to a predetermined position where the warning indicia and transparent means are aligned with each other, and for permanently locking the enclosing means and cap together in that predetermined position. Thus, once the enclosure means is rotated in a counter-clockwise direction from the predetermined position, set by the pre-positioning means, that rotation is limited to the position where the warning indicia and the transparent means are aligned. The locking means will prevent the enclosing means from being further rotated about the cap in either the clockwise or counter-clockwise direction and therefore locks the alignment of the indicia and the transparent means.

Since the closure must be removed from the container by rotating the enclosing means in a counter-clockwise direction about the cap, any tamper attempt will cause the display of the warning indicia and lock that display on the closure so that any potential customer or user will clearly see that the closure has experienced tampering. It will also be appreciated that since the warning indicia will be permanently displayed after the first removal of the closure, any subsequent user of the contents of the container will be warned that the container has been previously opened. This is, of course, quite acceptable when the first user is also the subsequent user, which will be the normal case in ordinary use by consumers.

Thus, the enclosing means and the cap must have three features, as explained above, i.e., it must have a prepositioning means, a clockwise anti-rotation means, and a counter-clockwise rotation limit and locking means. The mechanical arrangement to achieve these three features may be as desired, and a number of different mechanical arrangements can achieve these features. However, a particularly good mechanical arrangement to achieve these features, and the preferred form of the invention, is shown in the drawings. Turning again to FIG. 1, cap 4 is shown as being composed of two separate parts, i.e., a conventional threaded cap 20 and a surrounding cover 21 therefor. However, threaded cap 20 and cover 21 may be a monolithic unit. It is shown in the drawings as a threaded cap 20 and cover 21 simply to illustrate that a conventional cap 20, e.g. a metal or plastic cap, may be adapted by an appropriate cover 21 for achieving the purposes of the present invention. However, it is immaterial whether cap 4 is constituted by threaded cap 20 and cover 21, as separate elements, or as a single monolithic unit.

Enclosing means 10 must not be displaceable from cap 4 without visible damage to the enclosing means and/or cap. In other words, enclosing means 10 must be arranged so that it cannot be removed from cap 4 without that removal being most evident. Thus, enclosing means 10 may be pinned to cap 4 via nuts and bolts, threads etc. (not shown in the drawings), or enclosing means 10 may be permanently held to cap 4 by a one-way ratchet 23 and pawl 24. Thus, when enclosing means 10 is forced onto cap 4, during manufacture, the ratchet and pawl arrangement, while allowing rotation, will not allow enclosing means 10 to be vertically displaced from cap 4 without breaking the ratchet and/or pawl, and will thereafter prevent enclosing means 10 from being associated, in any kind of locked arrangement, with cap 4. This ensures that when the enclosing means is fitted over the cap, the one-way ratchet and pawl are engaged and the enclosing means cannot be displaced from the cap without visible damage to the ratchet and pawl.

The rotation in the counter-clockwise direction of enclosure 10 about cap 4, as described above, may be achieved by the enclosing means having an elongated recess, generally 30, on the inside surface thereof and the cap has at least one protuberance 32 on the outer surface thereof (also see FIG. 4), such that the protuberance is configured to be rotatably movable in recess 30.

Figure 3:
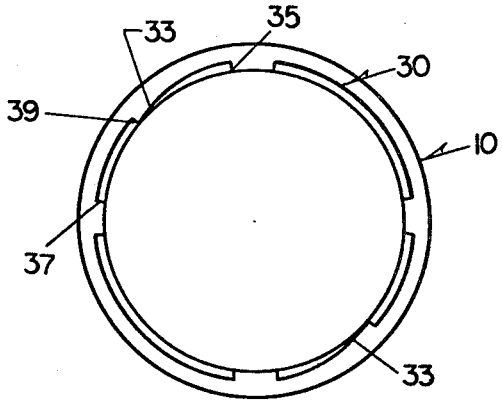
FIG. 3 is a bottom view of the closure of the invention, with the threaded cap portion thereof being deleted for clarity purposes.

As can best be seen from FIG. 3, which is a bottom view of closure 3 with cap 4 being removed for purposes of clarity, a portion of recess 30 is terminated by a ramp 33. Thus, the portion of recess 30 bounded by one end 35 thereof and ramp 33 functions as the pre-positioning means and when in that pre-positioning means, protuberance 32 will be in the desired predetermined position. The one end 35 of recess 30 also functions as the clockwise anti-rotation means. Thus, on filling the container, closure 3 may be threaded onto threaded neck 2 by rotating enclosing means 10 until protuberance 32 hits one end 35 of recess 30. Thereafter, clockwise rotation of enclosing means 10 may be continued to tightly thread cap 4 onto container 1, and even modern filling and closing machinery may be used in this regard.

Ramp 33 functions as the detent, mentioned above, since it will require some positive noticeable force to move protuberance 32, in a counter-clockwise direction, over ramp 33. This avoids inadvertant counter-clockwise rotation of enclosing means 10 relative to cap 4, such as might be experienced in handling, shipping and the like. Ramp 33 should be of such a size and configuration, in combination with protuberance 32, so that the force to overcome the detent created by ramp 33 is sufficient to require a noticeable force, but that force should be less than that which will be sufficient to rotate the cap in a counter-clockwise direction. In other words, the force to overcome the detent must not be enough force to loosen the tightened cap on a filled container.

The portion of recess 30 bounded by ramp 33 and the other end 37 of recess 30 functions as the counter-clockwise rotation limit and locking means. Thus, after the detent created by ramp 33 is overcome and protuberance 32 falls into the portion of the recess bounded by the other end 37 and the right angle portion 39 of ramp 33, protuberance 32 is locked into that portion of the recess. This is true because protuberance 32 cannot be rotated, in a clockwise direction, past right angle 39 of ramp 33 nor can it be rotated past the right angle termination of the other end 37 of recess 30. That locked position is also such that transparent means 14 is now aligned with warning indicia 12. It will also be appreciated that the right angle 39 of ramp 33 and the right angle of the other end 37 limits the clockwise and counter-clockwise rotation of enclosing means 10 relative to cap 4. By choosing transparent means 14 of a configuration so that warning indicia 12 is always visible within that limit of clockwise and counter-clockwise rotation, the warning indicia will be permanently displayed through transparent means 14.

Thus, as can therefore be appreciated, the ramp functions as the detent, the portion of the recess bounded by the ramp and the one end of the recess functions as the pre-positioning means, the one end of the recess functions as the clockwise anti-rotation means, and the portion of the recess bounded by the other end of the recess and the right angle of the ramp functions as the counter-clockwise rotation limit and locking means. It will also be appreciated that when the enclosing means is counter-clockwise rotated past the detent, the counter-clockwise rotation limit and locking means is automatically and permanently engaged.

Figure 5:
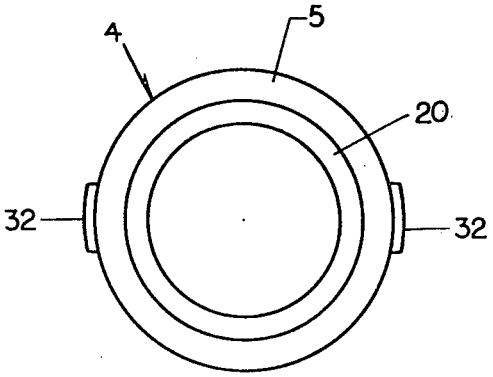
FIG. 5 is a bottom view of the cap portion of the present invention.

FIG. 5 is a bottom view of cap 4 and would ordinarily be disposed within enclosing means 10 of FIG. 3, but has been removed in the drawings for sake of clarity. However, by viewing FIGS. 3 and 5 together, it can be easily seen how cap 4 fits into enclosing means 10 and operates in the manner described above.

It should be fully appreciated, however, that the particular mechanical arrangement, described above, for providing the pre-positioning means, the clockwise anti-rotation means, and the counter-clockwise rotation limit and locking means are not critical and a variety of mechanical arrangements, other than that described, will be apparent to those skilled in the art. It is not the particular mechanical arrangement described above, but the required functions, which are necessary to the success of the present invention, although the particular mechanical arrangement described above is a most satisfactory mechanical arrangement and the preferred form of the invention.

It can also be easily appreciated that the present closure may be made of a variety of materials, including plastic, metal, and glass, although it will also be most apparent that the present closure can be most inexpensively made of plastic by simple injection molding techniques. This allows for a very inexpensive closure. Further, since cap 4 and closure 10 may each be molded as a monollithic unit, the assembly of the closure is exceedingly inexpensive to perform, since it only requires positioning of enclosing means 10 onto cap 4 at the predetermined position, as explained above, and forcing enclosing means 10 onto cap 4 to engage the ratchet and paw arrangement, or other similar devices, for ensuring that enclosing means 10 is not displaceable from cap 4, once assembly has been completed.

It will also be appreciated that modifications of the above are apparent to those skilled in the art, and it is intended that those apparent modifications be embraced by the spirit and scope of the annexed claims. It is also specifically noted that while the claims refer to the features of the invention in terms of counter-clockwise and clockwise directions, these directions may be reversed for reversal of the threads of the container, i.e. a reversal from a right-hand thread to a left-hand thread.

In the claims:

1. A tamper evident closure for a container having a threaded neck comprising:

(a) a cap having a side portion and a top portion, and cap threads associated with the side portion for engaging the neck threads such that the cap may be threaded onto the neck in a clockwise direction to close the container and threaded from the neck in a counter-clockwise direction to open the container;

(b) an enclosing means for enclosing the side portion and the top portion of the cap and being rotatable about the cap in the counter-clockwise direction;

(c) visible warning indicia disposed on at least one of the side portion and the top portion of the cap;

(d) transparent means associated with the enclosing means wherein the warning indicia on the cap is visible through the transparent means when the indicia and transparent means are in alignment with each other;

(e) pre-positioning means disposed on said enclosing means and said cap for releasably initially pre-positioning the enclosing means on the cap at a predetermined position where the said warning indicia is not aligned with nor visible through the transparent means;

(f) clockwise anti-rotation means disposed on said enclosing means and said cap for preventing clockwise rotation of the enclosing means about the cap so that the enclosing means and cap may be clockwise rotated to thread the cap into the neck and close a filled container without disturbing the pre-positioning of the enclosed means on the cap;

(g) counter-clockwise rotation limit and locking means disposed on said enclosing means and said cap for limiting the counter-clockwise rotation of the enclosing means about the cap to a predetermined position where said warning indicia and transparent means are aligned with each other, and for permanently locking the enclosing means and cap together in that predetermined position;

whereby rotation of the enclosing means about the cap in the counter-clockwise direction to first open the container results in the warning indicia being permanently visible through the transparent means.

2. The closure of claim 1 wherein the threads of the neck and the cap are either screw threads or bayonette threads.

3. The closure of claim 1 wherein the enclosing means is not displaceable from the cap without visible damage to the enclosing means and/or the cap.

4. The closure of claim 3 wherein the enclosing means and the cap have a one-way ratchet and pawl therebetween such that when the enclosing means is fitted over the cap the one way ratchet and pawl are engaged and the enclosing means cannot be displaced from the cap without visible damage to the ratched and/or pawl.

5. The closure of claim 1 wherein the warning indicia is not visible or only faintly visible through the enclosing means prior to opening the container.

6. The closure of claim 1 wherein the transparent means is a transparent portion of the enclosing means or an apperture in the enclosing means.

7. The closure of claim 1 wherein there are more than one warning indicia on the cap and a corresponding number of transparent means on the enclosing means.

8. The closure of claim 1 wherein the pre-positioning means has a detent such that the enclosing means is not easily rotated from the pre-position.

9. The closure of claim 8 wherein when the enclosing means is counter-clockwise rotated past the detent, the counter-clockwise rotation limit and locking means is automatically and permanently engaged.

10. The closure of claim 9 wherein the enclosing means has an elongated recess on an inside surface thereof and the cap has a protuberance on an outside surface thereof, said protuberance being configured to be rotatably movable in the said recess, and wherein a portion of the recess is terminated by a ramp, whereby the portion of the recess bounded by one end thereof and the ramp functions as the pre-positioning means, the said one end of the recess functions as the clockwise anti-rotation means, the ramp functions as the detent, the portion of the recess bounded by the ramp and the other end of the recess functions as the locking means and the said other end of the recess functions as the counter-clockwise rotation limit means.

11. The closure of claim 1 wherein the warning indicia is in the form of symbols, colors or words.

12. The closure of claim 1 wherein it is made of plastic or metal or a combination thereof.

* * * * *